US005174714A

United States Patent [19]

Plemmons et al.

[11] Patent Number: 5,174,714

[45] Date of Patent: Dec. 29, 1992

[54] HEAT SHIELD MECHANISM FOR TURBINE ENGINES

[75] Inventors: Larry W. Plemmons, Fairfield; John R. Hess, West Chester, both of Ohio

[73] Assignee: General Electric Company, Cincinnati, Ohio

[21] Appl. No.: 727,178

[22] Filed: Jul. 9, 1991

[51] Int. Cl.[5] ..... F01D 25/08

[52] U.S. Cl. ..... 415/177; 415/178; 29/525.1; 29/888.01; 29/888.3

[58] Field of Search ..... 415/177, 178, 170.1, 415/173.1, 173.3, 173.4, 174.2, 174.4; 29/888.01, 888.3, 525.1

[56] References Cited

U.S. PATENT DOCUMENTS

| | | | |
|---|---|---|---|
| 3,042,365 | 7/1962 | Curtis et al. | 415/173.4 |
| 3,365,172 | 1/1968 | McDonough et al. | 415/173.4 |
| 3,423,070 | 1/1969 | Corrigan | 415/173.4 |
| 3,656,862 | 4/1972 | Rahaim et al. . | |
| 3,970,319 | 7/1976 | Carroll et al. | 415/173.4 |
| 3,986,789 | 10/1976 | Pask | 415/178 |
| 4,087,199 | 5/1978 | Hemsworth et al. . | |
| 4,101,242 | 7/1978 | Coplin et al. . | |
| 4,398,866 | 8/1983 | Hartel et al. . | |
| 4,405,284 | 9/1983 | Albrecht et al. . | |
| 4,525,998 | 7/1985 | Schwarz . | |
| 4,565,492 | 1/1986 | Bart et al. . | |
| 4,826,397 | 5/1989 | Shook et al. . | |

*Primary Examiner*—Edward K. Look
*Assistant Examiner*—Christopher M. Verdier
*Attorney, Agent, or Firm*—Jerome C. Squillaro; John R. Rafter

[57] ABSTRACT

A heat shield mechanism for shielding a structure in a turbine engine having a sheet metal backing which is bonded to a plurality of honeycomb cells aligned in a radially outward manner toward a casing. The honeycomb cells and sheet metal backing form a heat shield which acts as a vortex destroyer by eliminating fluid flow around the turbine structure.

7 Claims, 2 Drawing Sheets

HEAT SHIELD MECHANISM FOR TURBINE ENGINES

CROSS-REFERENCES

This case is related to co-pending patent application Ser. Nos. 07/727,189; 07/727,268; 07/727,186; and 07/727,182 and 13DV-10788) filed concurrently herewith.

BACKGROUND OF THE INVENTION

The present invention relates to thermal shields for use in gas turbine engines and, more particularly, to a thermal shield for thermally insulating a turbine casing from high temperature fluid flow.

Thermal shields are used in gas turbine engines to thermally isolate particular structures from an active heat transfer environment. The effectiveness of these shields, which are a combination of a metal foil backing enclosing an insulation type blanket next to the structure, is directly dependent upon having no gaps or channels between the blanket and the structure and upon the blankets retaining their original shape. Gaps or channels between the blanket and the structure have an inherent "flow leak". Leaks have an associated flow velocity which can generate a significant heat transfer coefficient. The prior art has encountered problems in end sealing of these thermal or heat shields. Gaps between the heat shield and turbine structure allow heated fluid to flow over the structure which the heat shield is intended to protect. Thermal distortions and part-to-part tolerancing compromise the ability of the heat shield to act as an effective seal. Most heat shields used in standard turbine/compressor design applications, have an "inside" radial fit-up. This radial fit-up cannot be controlled effectively during engine transient operation. In addition, vibration of the engine structure can cause the fibrous insulation blanket to deteriorate and lose shape thereby providing a flow path between the blanket and the structure insulated by the blanket.

Thus, a need exists for an effective heat shield mechanism which alleviates the effect of gap leaks, which better isolates a turbine structure from hot fluid flow, and which has good dimensional stability under engine operating conditions.

SUMMARY OF THE INVENTION

Accordingly, it is a general one object of the present invention to provide a thermal shield mechanism for a gas turbine engine which minimizes the above and other disadvantages of prior art thermal shields.

It is a more specific object of the present invention to provide an effective thermal shield for thermally isolating a gas turbine structure from an active heat transfer environment and simultaneously to inhibit fluid flow in any gaps which may occur between the structure and thermal shield. The thermal shield comprises a honeycomb type structure formed as an insulating sheet with a plurality of predeterminately sized cells. A backing plate is affixed to one surface of the honeycomb sheet so that one end of the cells is closed. The insulating sheets are positioned adjacent selected areas of the engine casing with the open ends of the cells facing the casing and the backing plate defining an inward flow guide for high temperature gases. In one form, the thermal shield comprises a plurality of insulating sheets arranged circumferentially about the engine in a generally abutting relationship with the open ends of the honeycomb cells generally restrained against the casing surface to be protected. In the event of gaps between the open cell ends and adjacent casing surface, gases attempting to flow through such gaps will be subjected to flow impediment from the uneven surface defined by the open cell ends. The cells are predeterminately sized to create localized flow vortices to further impede gas flow through the gap. Since the rate of heat transfer is related to flow rate, the slowing of flow through the gap by such vortex effect reduces the heating effect of gases entering any such gap.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it should be understood that like reference numerals designate identical or corresponding parts throughout the respective figures.

DETAILED DESCRIPTION OF THE INVENTION

Figure 1:
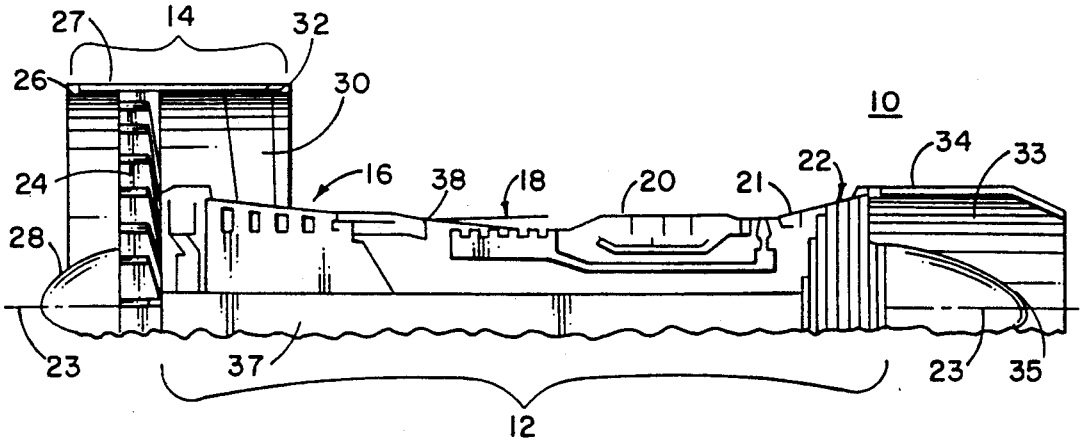
FIG. 1 (PRIOR ART)
FIG. 1 is a simplified partial cross-sectional drawing of an exemplary gas turbine engine.

Referring first to FIG. there is shown a partial cross-sectional drawing of an exemplary high-bypass ratio gas turbine engine 10 having a rotor engine portion indicated at 12 and a stator or fan portion indicated at 14. The engine portion 12 may be referred to as the rotor module. The rotor engine portion 12 includes an intermediate pressure compressor or booster stage 16, a high pressure compressor stage 18, a combustor stage 20, a high pressure turbine stage 21, and a low pressure turbine stage 22 all aligned on an engine centerline 23. The engine further includes fan blades 24 and a spinner assembly 28. The fan portion 14 comprises fan cowling 27 and fan casing 26. The fan cowling 27 surrounds the fan casing 26 and radially encloses the fan portion of the engine 10.

The fan spinner assembly 28 located forward of the fan blades 24 connects to a rotor assembly (not shown) drivingly coupled to blades 24 and being driven by turbine stage 22. To the aft of fan blades 24 is located a plurality of circumferentially spaced outlet guide vanes or fan frame struts 30 which are a part of the fan portion 14. The outlet guide vanes 30 connect the engine portion 12 to the fan portion of the engine 10 and provide structural support. At the rear of engine 10 is located primary nozzle 33 which includes an outer member 34 and an inner member 35. The fan shaft 37 driven by turbine stage 22 extends through the engine and is coupled in driving relationship with booster stage 16 and fan blades 24 via the fan rotor assembly. The engine portion 12 is positioned in and supported by an outer casing 38.

In the operation of engine 10, air is drawn into the engine by fan blades 24 and compressed in two steps by compressor stages 16 and 18. The compressed air is directed at least in part into the combustor stage 20 where it is mixed with fuel and ignited to create a high temperature, high velocity gas stream. This gas stream is directed into the turbine stages 21, 22 where it reacts against rotatable turbine blades within the stages to effect their rotation. Non-rotatable or stationary guide vanes alternate with the rotatable blades to control the direction of the gas stream impinging on the blades. The turbine stages then drive the shafts coupled to the compressor stages and fan blades 24.

Because the gas stream exiting the combustor stage 20 is at a relatively high temperature, e.g., 2000° F. or higher, it is necessary to provide some method of cooling at least some of the turbine vanes and adjacent structure. One method of cooling the turbine vanes is to form the vanes with hollow cores, provide a plurality of small holes penetrating the vanes and then inject cooling air into the vanes under pressure so that it flows out the small holes and establishes a film on the vane surface to insulate the vane from the hot gas stream. The rotatable blades are connected to a rotor shaft and project radially outward. The stationary vanes are supported radially at their radial inner ends and supported axially at their radially outer ends adjacent the engine casing by support structure 44. Accordingly, cooling air must be channeled adjacent the casing to reach the roots of the stationary vanes for injection thereinto. Since the cooling air must have sufficient pressure to be forced outward of the vanes despite the high energy gas stream flow over the vane surface, the cooling air is drawn from the high pressure compressor stage 18. While defined as "cooling air", it will be appreciated that such air may have a temperature in the range of 900°-1000° F.

One disadvantage of the use of such cooling air is that if it flows adjacent the engine casing, the heating effects are such to create stress and thermal deformation of the casing and attached structures. Such deformation is undesirable since it affects clearance between turbine blades and the casing. Any change in such clearance affects turbine efficiency by allowing some of the gas stream to bypass the blades and thus not contribute to work in effecting rotation of the blades. Gas turbine engines are therefore generally provided with some form of insulation to protect the engine casing from the high temperature effects of the cooling air supplied to the turbine vanes.

The same effects described may also be noted in compressor stages such as stage 18 even though the temperatures may be less than that in the turbine stage. As a general practice, casing structures adjacent at least some compressor stages are also insulated to prevent thermal distortion.

Figure 2:
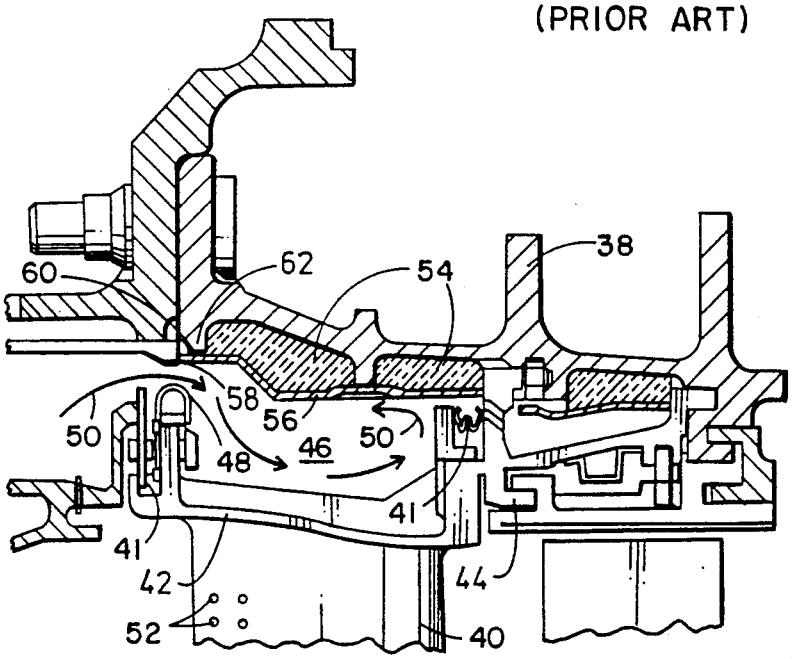
FIG. 2 (PRIOR ART)
FIG. 2 is a cross-sectional schematic illustration of a prior art heat shield and turbine structure.

With reference to FIG. 2, there is shown a simplified, enlarged view of the turbine section of engine casing 38 adjacent a stationary blade row indicated by blade 40, the radial inner end of which has been truncated. The radial outer end of blade 40 is attached to and supported by an annular nozzle structure 42 which forms an outer flow path boundary for air flow through the turbine. Due to thermal differentials and vibrations, it is not desirable to fixedly attach the nozzle structure 42 to the casing 38 or to the structural elements 44 coupled to the casing. Instead, a plurality of leaf spring-like members 41 and a spring-like member 43, having a generally W-shaped cross-section, are positioned about the nozzle structure 42 to provide an air seal. The W-seal 43 at the axially aft end of the nozzle structure 42 forms a barrier so that an annular cavity 46 is formed above the nozzle structure 42 with an axially forward opening 48 for receiving a stream of cooling air, indicated by arrows 50. The cooling air 50 flows into the cavity 46 and is distributed into each of the generally hollow blades 40. The cooling air exits each of the blades 40 through cooling holes 52 predeterminately spaced along the blade surface to form a cooling film on the surface in a well known manner.

As the cooling air 50 enters the cavity 46, its velocity is reduced and it expands to fill the cavity space. As a consequence, there is created a pressure differential between the opening 48 and the axial aft end of the cavity. The static pressure at the axial aft end becomes higher than the static pressure at opening 48. The result is a circulating air flow within the cavity 46 as indicated by the arrows 50. As previously discussed, it is desirable to prevent this cooling air from impinging on the inner surface of casing 38 since the cooling air is generally at a higher temperature than the casing 38. The casing 38 is preferably cooled from its radially outer surface to minimize thermal distortion and maintain clearance control with respect to rotating blades in the turbine section. In the prior art system of FIG. 2, the cooling air 50 is isolated from the casing 38 by a thermal blanket 54 which may be formed of a fibrous insulating material supported within a flexible metal film material. The blanket 54 is supported adjacent the casing 38 by an annular sheet metal, cylindrical sleeve 56. The sleeve 56 fits within the space between an axially forward end of cavity 46 and the axially aft end of the cavity. A plurality of tabs 58 extend axially forward from sleeve 56 and fit with mating slots 60 in an annular flange 62 depending radially inward of casing 38. The tabs 58 restrain the sleeve 56 against circumferential rotation. The sleeve 56 is not otherwise fastened to casing 38 since the temperature differentials between the sleeve and casing would create maintainability problems due to thermal growth differentials. This lack of attachment allows gaps to be formed around the sleeve 56 such that air 50 circulates above the sleeve and around insulation blanket 54. Vibration and heat cycling of the blanket 54 cause the blanket to lose contact with casing 38 so that gaps are formed adjacent the casing through which the cooling air 50 can circulate.

Figure 3:
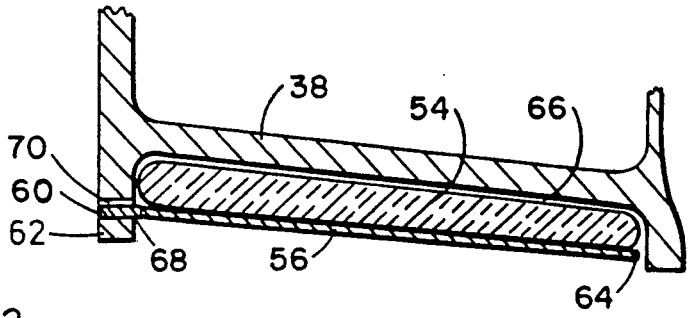
FIG. 3 (PRIOR ART)
FIG. 3 is a simplified schematic representation of the radial fit-up interface of a prior art turbine structure and heat shield.

Turning briefly to FIG. 3, there is shown a simplified representation of the casing 38, blanket 54, and sleeve 56 which illustrates various gaps which may occur due to thermal effects and allow air 50 to contact casing 38. A gap 64 may form circumferentially between the aft end of sleeve 56 and the adjacent structure of casing 38. The blanket 54 may separate from casing 38 forming a gap 66. At the axially forward end of sleeve 56, there may be a gap 68 between the sleeve and flange 62 and additional gaps 70 through slots 60. The cooling air 50 circulating through these gaps will create thermal distortion of the casing 38 since the cooling air temperature is generally higher than the desired casing temperature.

Figure 4:
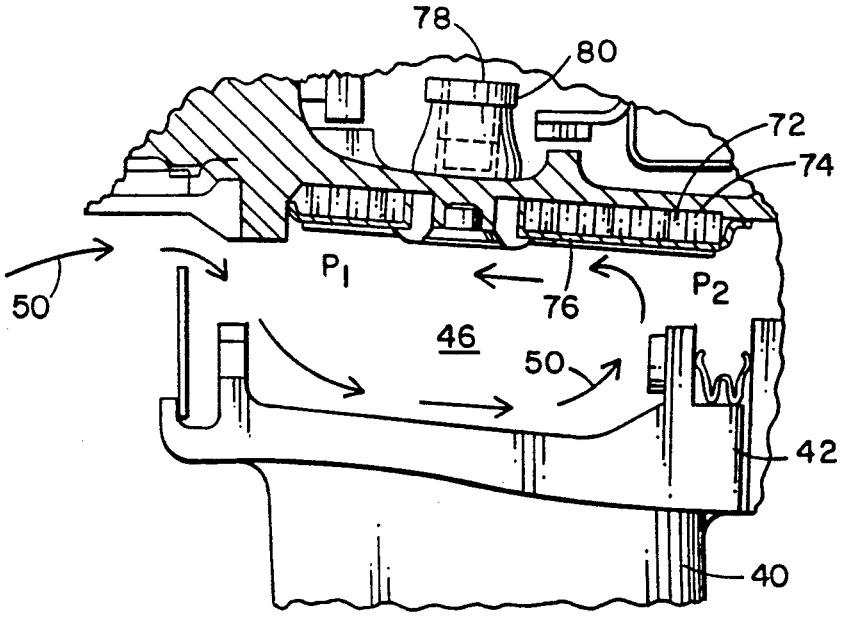
FIG. 4 is a schematic cross-sectional illustration of a heat shield assembled in a gas turbine engine in accordance with one embodiment of the present invention.
Figure 5:
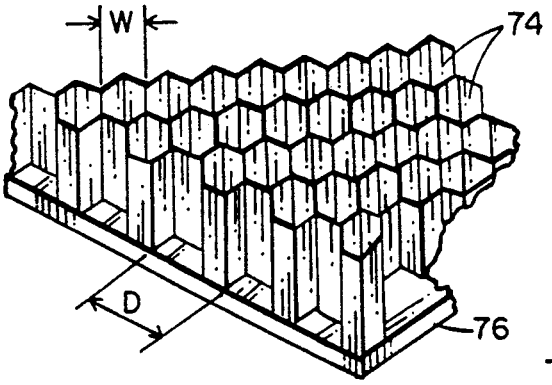
FIG. 5 is a cross-sectional perspective illustration of the sheet metal backing and honeycomb cell structure of the heat shield of the present invention.

Referring now to FIG. 4, there is shown a view similar to that of FIG. 2 but incorporating a heat shield arrangement in accordance with the present invention. The improved heat shield 72 comprises a honeycomb type structure having a plurality of open-ended cells 74 supported adjacent the radially inner surface of casing 38. A backing sheet 76 covers the radially inner ends of the cells 74. Turning briefly to FIG. 5, there is shown an enlarged view of a honeycomb heat shield 72 illustrating the cells 74 and backing sheet 76. The cells 74 in one form may comprise six-sided metal tubular elements and the metal backing sheet 76 may be brazed to one end of the cells to form the illustrated structure. Honeycomb structures of this form are commercially available with various thicknesses d and various cell sizes. Referring again to FIG. 4, the honeycomb heat shield 72 may comprise a plurality of preformed arcuate segments which are individually attached to the casing 38 by means of bolts 78 and nuts 80. It Will be appreciated that the shield segments could be attached in other ways, such as by use of a threaded insert in the shield segment and a bolt inserted from outward of the casing. Still further, any attachment which assures continued urging of shield 72 against casing 38 without interfering with air flow into the vanes 40 could be used. Furthermore, the shield 72 may be formed in large circumference arcuate sections and, in the extreme, as a single circumferential ring which would relieve problems associated with urging the shield into contact with the casing 38. For ease of assembly, the single ring could be cut at one point to form a closed C-shape allowing the ring to be distorted for insertion.

The sizing and thickness d of each of the honeycomb cells 74 has been found to be significant in controlling heating of the casing 38. While the metal structure of the shield 72 allows it to be continuously urged toward the casing 38, thermal growth differentials and localized heat differentials continue to cause some gaps to be formed between the shield 72 and casing 38. The differential static air pressure attempts to force an air flow through any gaps between the shield and casing. An important advantage of the open honeycomb cells 74 adjacent any gap between the shield and casing is that the open cell ends create a high viscous drag on any air leakage flow and reduces flow velocity to near zero. Since the convective heat transfer coefficient is proportional to flow rate, the shield 72 is effective in reducing convective heat transfer even if gaps occur between the open cell ends and casing 38. However, shield 72 also acts as a conduction and radiation heat shield.

In order to produce the high viscous drag adjacent the cell ends, the shield 72 must have some minimum thickness. In an exemplary embodiment, a cell depth of at least 0.1 inch was found sufficient to create a viscous drag to reduce flow. Cell size is important so that the cell surface appears discontinuous. A cell dimension W from wall-to-wall (see FIG. 5) of about at least 0.0625 inches has been found sufficient to create the aforementioned drag effect. Still another consideration in cell sizing is the thickness of each cell wall since heat transfer by conduction can occur through the cell wall from sheet 76 to casing 38. A wall thickness of between about 0.002 to 0.004 inches has been found to afford sufficient thermal isolation.

In FIG. 4, hot fluid (cooling air) flow 50 is shown to enter the cavity 46 located below the honeycomb shield 72 and above nozzle structure 42. The static pressure $P_1$ at the front of the chamber is lower than static pressure $P_2$ at the axially aft end of the cavity 46. This fact and the shape of the chamber causes fluid flow 50 to flow in a counterclockwise manner. In the prior art, this higher pressure $P_2$ resulted in hot fluid being driven into the gaps located between the heat shields and the structures they were designed to protect.

Figure 6:
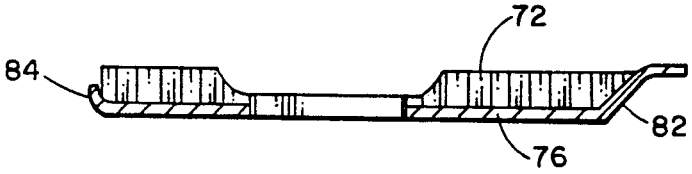
FIG. 6 is a schematic illustration depicting the tapered ends of the backing strip of the heat shield assembly of the present invention.

As a measure to further prevent the flow of heated fluid through gaps located between a heat shield mechanism and a surrounding structure, the backing sheet 76 of the present invention is provided with tapered ends. With reference to FIG. 6, the backing sheet 76 has tapered ends 82 and 84 which serve to prevent channel leaks. However, any leakage flow which is present is dealt with by the honeycomb cells through the high vicious drag on any leakage flow. Since the flow velocity is negated by the present invention, perfect end sealing and radial fit-up is not crucial to avoiding thermal problems.

The heat shield of the present invention, in having sheet metal honeycomb cells bonded to a backing strip that is held against the turbine structure 38, provides an improvement over the prior art in protecting a turbine structure from thermal damage. Honeycomb cells 74 act as a vortex destroyer to any potential flow between the shield and the structure 38. This results in the flow velocity around the turbine structure to be effectively zero so as to achieve a lower heat transfer coefficient.

In the prior art, heat shields were susceptible)e to small channel leaks which resulted in high heat transfer areas which in turn resulted in circumferential temperature gradients being present in the structure. However, the present invention, in not being susceptible to small channel leaks, effectively thermally isolates the structure it is intended to protect against thermal damage.

The foregoing detailed description is intended to be illustrative and non-limiting. Many changes and modifications are possible in light of the above teachings. Thus, it is understood that the invention may be practiced than as otherwise specifically described herein and still be within the scope of the appended claims.

What is claimed is:

1. A method of assembling a gas turbine engine, the gas turbine engine including a casing defining in part at least one passage for the flow of cooling air within the casing, a thermal shield including a plurality of adjacent honeycomb cells each having an open end and a closed end, the method comprising the step of:

associating the thermal shield in thermal insulating relation with the casing within the at least one passage and arranging the thermal shield in engagement with the casing generally about at least some of the open ends of the honeycomb cells with the thermal shield adjacent the closed ends of the honeycomb cells being exposed to the at least one passage during the associating step.

2. A gas turbine engine comprising:

a) a casing defining in part at least one passage means for the flow of cooling air within said casing;

b) means for thermally insulating said casing within said at least one passage means, said thermal insulating means including a plurality of generally adjacent honeycomb cells each having an open end and a closed end, said thermally insulating means being engaged with said casing generally about the open end of at least some of said honeycomb cells and being exposed to said at least on passage means adjacent said closed ends of said honeycomb cells; and c) wherein said open ends of others of said honeycomb cells in said thermally insulating means are displaced from said casing in response to thermal distortion of at lest one of said casing and said other of said honeycomb cells.

3. The gas turbine as set forth in claim 2 further comprising at least one means associated with said thermal insulating means for maintaining said thermally insulating means in a preselected position within said at least one passage means with respect to said casing.

4. The gas turbine as set forth in claim 2 wherein said closed ends of said honeycomb cells define a generally uniform surface exposed to said at least one passage means.

5. The gas turbine as set forth in claim 2 wherein said thermally insulating means further includes means associated therewith for closing said closed ends of said honeycomb cells and for presenting a generally uniform surface to said at least one passage means.

6. The method of claim 1, further comprising the step of creating a high viscous drag on a leakage flow entering a gap between said open ends of others of said honeycomb cells and said casing, thereby impeding said leakage flow.

7. The gas turbine as set forth in claim 2, wherein said open ends of said other of said honeycomb cells create a high viscous drag on a leakage flow entering a gap between said open ends of said others of said honeycomb cells and said casing, thereby impeding said leakage flow.

* * * * *